United States Patent [19]

Fay

[11] 4,192,017

[45] Mar. 11, 1980

[54] VISORED HEADGEAR

[75] Inventor: William L. Fay, Wellesley Hills, Mass.

[73] Assignee: Visor-Trac, Inc., Rockville Center, N.Y.

[21] Appl. No.: 883,874

[22] Filed: Mar. 6, 1978

[51] Int. Cl.[2] ..... A42B 1/00; A42B 1/24

[52] U.S. Cl. ..... 2/12; 2/183; 2/209.3; 40/329

[58] Field of Search ..... 2/7, 8, 10, 12, 13, 2/452, 171.1, 171.2, 171.5, 171.6, 171.7, 171.8, 172, 173, 181, 181.4, 181.8, 182.2, 206, 177, 178, 179, 185 R, 191, 195, 183, 175, 171; D2/244–248; 40/329, 586

[56] References Cited

U.S. PATENT DOCUMENTS

| | | | |
|---|---|---|---|
| D. 244,567 | 6/1977 | Bocskay | D2/244 |
| 757,854 | 4/1904 | Wickersham | 2/12 |
| 929,240 | 7/1909 | Novoson | 2/187 X |
| 1,050,310 | 1/1913 | Steinberg et al. | 2/172 |
| 1,110,350 | 9/1914 | Schneider | 2/12 |
| 1,128,170 | 2/1915 | Marks | 2/185 R |
| 1,715,201 | 5/1929 | Levin | 2/183 |
| 1,808,966 | 6/1931 | Morgan | 2/177 X |
| 2,004,471 | 6/1935 | David | 2/195 X |
| 2,009,855 | 7/1935 | Osmer | 2/12 X |
| 2,445,230 | 7/1948 | Mattsson et al. | 2/195 |
| 2,896,218 | 7/1959 | Lipschutz | 2/195 |
| 3,608,094 | 1/1969 | Gallin | 2/209.3 |

FOREIGN PATENT DOCUMENTS

| | | | |
|---|---|---|---|
| 180805 | 2/1936 | Switzerland | 2/12 |
| 196800 | 5/1923 | United Kingdom | 2/12 |
| 132077 | 4/1949 | United Kingdom | 2/175 |

*Primary Examiner*—Werner H. Schroeder
*Assistant Examiner*—Andrew M. Falik
*Attorney, Agent, or Firm*—Robert T. Gammons; Donald Brown

[57] ABSTRACT

Headgear comprising a head-encircling band of extruded or molded thermoplastic having a channel formed along one edge and a transparent crescent-shaped plastic visor attached at its concave edge to the band within the channel so that said edge is concealed within the channel and said transparent visor, embodying within its diameter a pocket provided by a layer of plastic welded thereto within which is sealed a logo or emblem.

1 Claim, 15 Drawing Figures

VISORED HEADGEAR

BACKGROUND OF INVENTION

Plastic visors such as are employed to reduce glare are customarily attached along one edge to a fabric or plastic head-encircling band and since the edge of the visor is exposed, it can cause considerable discomfort. It is, accordingly, an object of this invention to provide a headband designed to receive the rigid edge of the visor where the latter is attached thereto which will conceal and cushion the edge. The structure as thus made avoids the use of multiple parts which require assembling and stitching and is particularly well adapted to be incorporated in a conventional cap or hat where a visor is desirable wherein it will serve the double purpose of a support for attachment to the body of the cap or hat and for a sweatband as well as for an attachment of the visor thereto. Still another advantage derived from the fact that it can be manufactured inexpensively is that the plastic visor provides an ideal means for displaying emblems, logos and the like which make it attractive as a giveaway item for advertising purposes.

SUMMARY OF THE INVENTION

The headgear according to this invention comprises a narrow elongate band of flexible plastic, means at the ends thereof for adjustably connecting the ends to each other to form a head-encircling band, said band having along a portion of its length a channel, a transparent visor member mounted to the band with an edge seated within the channel and means for securing the edge of the transparent visor member in said channel. The channel is defined by spaced lips along one edge of the band disposed at an angle to the plane of the band integrally connected to said edge by a process of extrusion or molding. The visor is crescent-shaped and the concave edge of the visor is secured in the channel between the lips by means of a course of stitching, adhesive or welding. The means for securing the ends of the bands to each other may comprise a buckle, straps attached to the ends provided with spaced holes and correspondingly-spaced posts adapted to be pressed into said holes or an elastic band. A logo or emblem is attached to the visor so as to be visible at the top side thereof within a sealed pocket formed at the underside of the visor by a plastic backing member secured to the underside.

The invention will now be described in greater detail with reference to the accompanying drawings, wherein.

Figure 1:
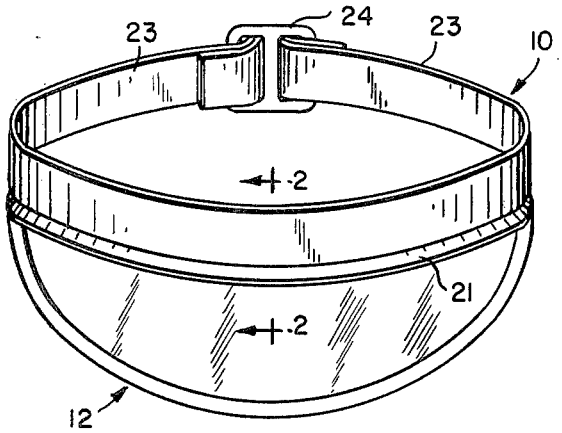
FIG. 1 is an isometric view of the headgear of this invention.

Referring to the drawings, the visored structure shown herein comprises essentially a circular headband 10 adapted to be adjusted for head size and a crescent-shaped visor 12 attached along one edge to the forepart of the headband.

Figure 2:
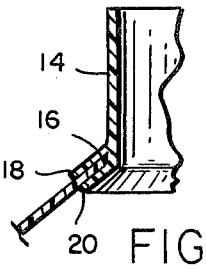
FIG. 2 is a section taken on the line 2–2 of FIG. 1.

The headband 10 as shown in FIG. 2 is comprised of a band 14 of flexible plastic having along one edge a channel 16 defined by a pair of lips 18 and 20 . The visor 12 is comprised of a piece of crescent-shaped transparent plastic and is secured to the band 14 with its concave edge 22 seated within the channel 16 between the lips 18 and 20, for example, by stitching the concave edge 22 to the lip 20, or by cementing or welding the lips 18 and 20 to the opposite sides of the concave edge 22. For cementing, commercially available rubber adhesive may be used and, for welding, high frequency heating may be employed. As thus constructed, the lips 18 and 20 conceal the means for fastening the visor to the band 14 and the channel within which the visor is secured serves to cushion the sharp edge of the visor next to the head and thus provides for head comfort.

Figure 4:
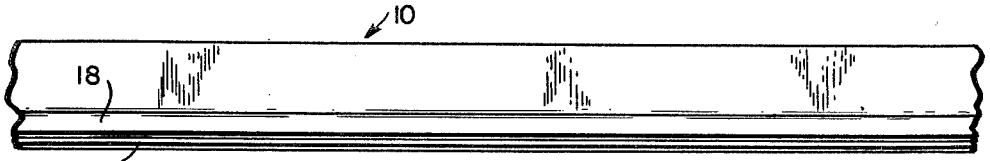
FIG. 4 is plan view of an extruded length of plastic from which the head-encircling band is cut.

In one form of the invention, the band 14 is formed by cutting an appropriate length from the extrusion shown in FIG. 4 and then trimming portions of the lips from the edge so as to provide a center portion 21 of sufficient length to receive the concave edge of the visor and relatively narrow end portions 23—23.

The extrusion is comprised of an extruded plastic such as polyethylene, polyurethane, polyvinyl chloride or any equivalent thereof and, as shown, the lips 18, 20 are disposed at an obtuse angle to one side.

Figure 7:
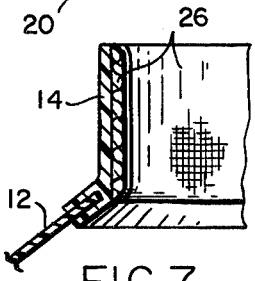
FIG. 7 is a section like FIG. 2 showing a sweatband adhesively attached to the inner side of the head-encircling band.

If desirable, as shown in FIG. 7, a sweatband 27 may be attached to the inner side of the band 14 either by stitching or the use of pressure-sensitive adhesives. The sweatband may be expanded polyurethane or felt provided with a pressure-sensitive adhesive at one side so that it can be stripped off for washing or replacement.

Figure 5:
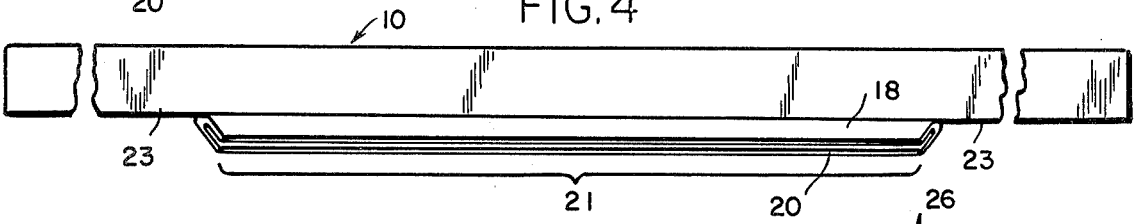
FIG. 5 is a plan view of a head-encircling band cut from the extruded length shown in FIG. 4.
Figure 6:
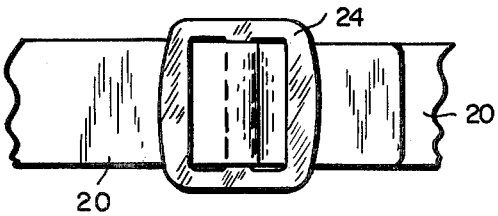
FIG. 6 is a fragmentary elevation as seen from the rear side of FIG. 1 showing one form of fastening means.
Figure 8:
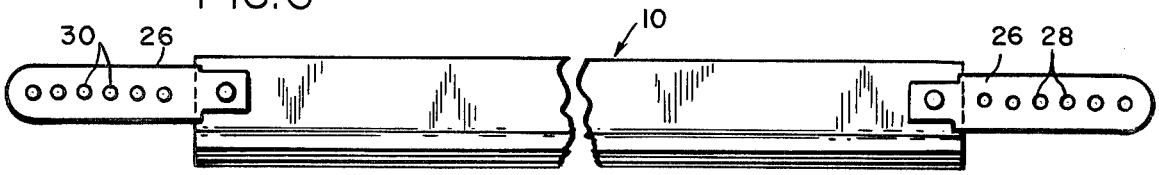
FIG. 8 is a plan view of a head-encircling band cut from the extruded length shown in FIG. 4 provided with a different form of fastening means.

Optionally, the band 14, as shown in FIG. 8, may be made shorter than that shown in FIG. 5 and without trimming the portions 20—20, narrow strips 26—26 can be stapled or riveted to the opposite ends, one of which contains a series of spaced holes 28 and the other a series of correspondingly spaced pegs 30 for interengagement with the holes, thus providing for ease of adjustment of the band to the head.

Figure 3:
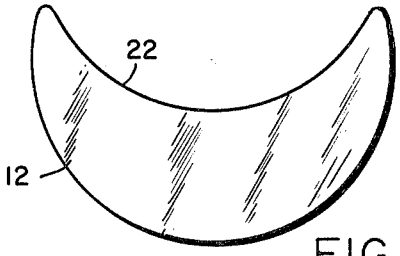
FIG. 3 is a plan view of the visor prior to attachment to the headband.
Figure 9:
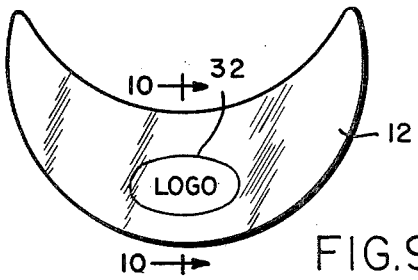
FIG. 9 is a plan view of the visor prior to attchment to the head-encircling band provided with a see-through logo.
Figure 10:
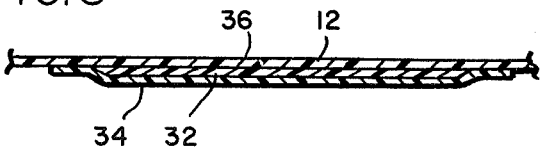
FIG. 10 is a section taken on the line 10—10 of FIG. 9 showing a logo-receiving pocket at the underside of the visor.

The visor 12, as previously related, is transparent and may, if desired, be tinted to diffuse the light somewhat, thus to reduce the glare. The visor is also constructed to receive a logo or emblem 32 such as to make the headgear particularly attractive for displaying brand names, emblems, and the like. This is achieved, as shown in FIGS. 3, 9 and 10, by welding to one side surface of the visor within the perimeter of the visor a cover piece of plastic 34 to provide a pocket 36 at the underside of the visor for receiving the logo 32 which, because of the transparency of the visor itself, is visible from the upper side of the visor. The logo may be composed of any suitable sheet material, for example, paper on which the logo is printed. The cover piece 34 may be transparent or opaque, tinted or untinted and, optionally, the logo may be imprinted or stenciled thereon so that when welded to the visor, the logo will show through the visor. The cover piece 34 may be applied to the upper side of the visor. However, the more attractive location is at the underside of the visor and may be coextensive with the visor or only of such size and shape as to cover the logo, for example, oval, as shown in FIG. 9.

Figure 11:
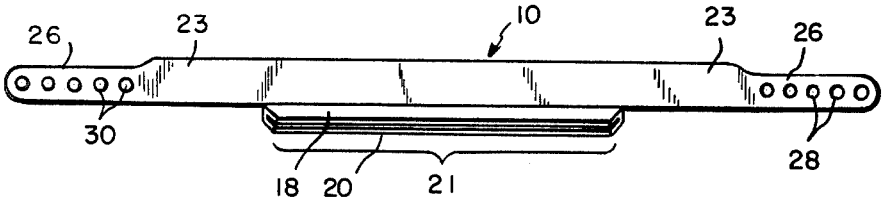
FIG. 11 is a plan view of a head-encircling band made by injection molding in one piece.
Figure 14:
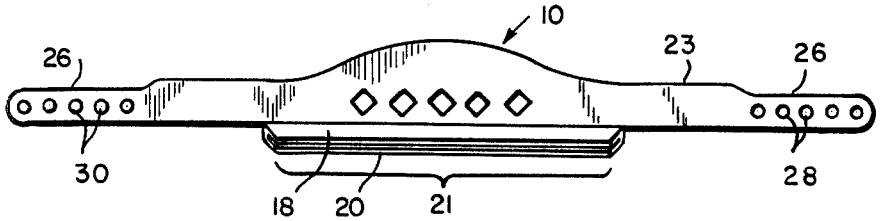
FIG. 14 is a plan view of the headband shown in FIGS. 12 and 13 formed by injection molding.
Figure 12:
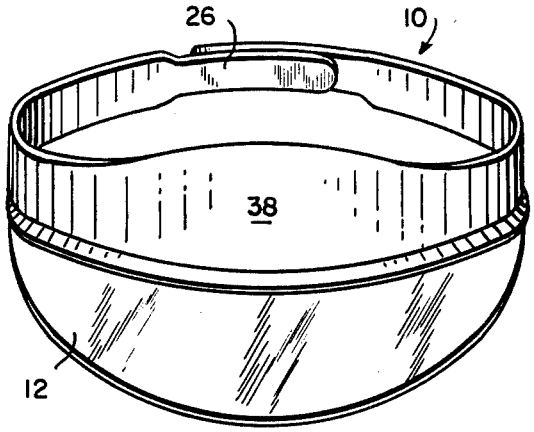
FIG. 12 is an isometric view of an alternative form of the invention as seen from the front.
Figure 13:
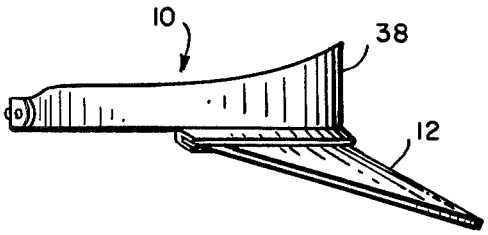
FIG. 13 is an elevation as seen from one side of FIG. 12.
Figure 15:
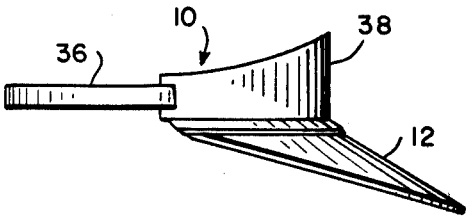
FIG. 15 is an elevation as seen from one side of an alternative form of the headgear shown in FIGS. 12 and 13 wherein the sides and back part of the band are aborted and replaced with an elastic band.

As an alternative to extrusion, the headband 10, as shown in FIG. 11, may be made by injection molding and, for this purpose, polyurethane is employed because it can be injection molded at a low pressure. By employing injection, molding, the headband with the lips along one edge for receiving the visor and the straps can be formed in one piece, thus eliminating trimming and/or the attaching steps to connect the bands. Injection molding also affords an inexpensive way of providing surface decoration and contouring of the band as shown in FIGS. 12 and 13. Still further, the structure as shown in FIG. 15 may be molded without the side and back part head-encircling portions and the aborted ends of the forepart connected by an elastic band 36.

The structure described above may be incorporated in the body of a cap to provide a more complete head covering with the advantages of economy in manufacture and utility for advertising purposes as already discussed.

As previously related, the sweatband may be stripped off for washing or replacement. So also the entire headgear may be washed without fear of shrinkage or loss of shape. Desirably, the headgear may be sold with an extra supply of sweatbands to enable continuous use without a waiting period for washing and drying a sweatband. A further advantage of this structure resides in the fact that the logo cannot be stripped from the visor or obliterated and that, by contouring the forepart of the headband, the crest 38 provided thereby provides additional space for identification of the wearer and/or the product being advertised.

It should be understood that the present disclosure is for the purpose of illustration only and includes all modifications or improvements which fall within the scope of the appended claims.

I claim:

1. Headgear comprising a headband and a visor, said headband comprising an elongate, flexible strip of extruded plastic embodying a head-encircling portion and a visor-retaining portion disposed at an oblique angle to the head-encircling portion containing an integrally formed slot for receiving an edge of the visor, means at the opposite ends of the head-encircling portion for securing the band about the head comprising a part connected at one end to one end of the head-encircling portion containing a plurality of uniformly-spaced perforations and a part connected at one end to the other end of the head-encircling portion containing uniformly-spaced nubs adapted to be frictionally engaged with the perforations in the one part and said visor comprises a crescent-shaped part having a concave edge disposed in the slot and secured therein, said visor being transparent, a logo disposed in engagement with the visor so that it is visible through the visor at the top side thereof and a part secured to the visor over the logo to retain the latter in place.

* * * * *